United States Patent [19]

Henschel et al.

[11] Patent Number: 4,931,243

[45] Date of Patent: Jun. 5, 1990

[54] PROCESS AND APPARATUS FOR SPREADING A CHIP WEB

[75] Inventors: Walter Henschel, Otzberg; Manfred Riesner; Uwe Kunstmann, both of Rossdorf, all of Fed. Rep. of Germany

[73] Assignee: Carl Schenck AG, Fed. Rep. of Germany

[21] Appl. No.: 191,041

[22] Filed: May 6, 1988

[30] Foreign Application Priority Data

May 23, 1987 [EP] European Pat. Off. ..... 87107526.3

[51] Int. Cl.[5] ..... D04H 1/72; D04H 17/00

[52] U.S. Cl. ..... 264/109; 264/37; 264/40.2; 264/121; 425/83.1; 425/141; 425/217; 425/470

[58] Field of Search ..... 264/518, 113, 121, 37, 264/40.1, 40.2, 40.7, 109; 425/80.1, 81.1, 82.1, 83.1, 141, 217, 470

[56] References Cited

U.S. PATENT DOCUMENTS

| | | | |
|---|---|---|---|
| 2,943,365 | 7/1960 | Erickson et al. | 425/80.1 |
| 4,353,686 | 10/1982 | Hosler et al. | 425/83.1 |

FOREIGN PATENT DOCUMENTS

| | | | |
|---|---|---|---|
| 0069162 | 7/1981 | European Pat. Off. . | |
| 0109456 | 11/1982 | European Pat. Off. . | |
| 0230483 | 1/1986 | European Pat. Off. . | |
| 2024490 | 5/1970 | Fed. Rep. of Germany . | |
| 2444470 | 9/1974 | Fed. Rep. of Germany . | |
| 2942163 | 4/1981 | Fed. Rep. of Germany | 425/80.1 |
| 3109151 | 10/1982 | Fed. Rep. of Germany | 425/83.1 |
| 984650 | 4/1949 | France . | |
| 7503204 | 4/1976 | France . | |
| 352129 | 3/1961 | Switzerland | 264/113 |

*Primary Examiner*—Jan H. Silbaugh
*Assistant Examiner*—Mary Lynn Fertig
*Attorney, Agent, or Firm*—Connolly and Hutz

[57] ABSTRACT

Process and apparatus for spreading a chip web from a supply over a width corresponding to the web width on a substrate moving below the supply. Such spreading is accomplished according to a web height distribution specified in the web transversely to the direction of web travel. The apparatus includes a rake-like distribution device and a distribution chute arranged between the supply and the web laydown for the purpose of eliminating defects caused by delivery elements in the transverse distribution of the chip web. An arrangement of several rakes inclined toward one another functions to control the transverse chip distribution.

9 Claims, 2 Drawing Sheets

PROCESS AND APPARATUS FOR SPREADING A CHIP WEB

BACKGROUND OF THE INVENTION

The present invention relates to process and apparatus for spreading a chip web from a supply over a width corresponding to the width of the web on a substrate moving below the supply according to a web height distribution specified in the web transversely to the direction of travel of the web.

European Patent No. 0 063 162 describes a process for influencing the density distribution of a chip web to be spread as well as an apparatus for this purpose. From at least one partial flow over a part of its width according to a specified density distribution, a resulting partial amount is removed. By removing a partial amount from a continuous partial flow extending over the width, a desired density distribution is obtained at the site of removal. However, since a further mixing with uninfluenced partial flows takes place, the desired result of a uniform specified density distribution in the laid down web is difficult to obtain.

Also, European Patent No. 0 109 456, describes process and apparatus for equalizing the density distribution in an artifical wood board in which, as a function of the weight distribution measured over a delivery cross section of the bulk material delivered from a supply, a separation command is developed for the amount of bulk weight present in corresponding partial cross sections and deviating from a specified target density distribution for its separation. Such a process is also based on a supply which is delivered over the entire future web width via removal devices so that density fluctuations present in the supply over the entire width also influence the amount to be removed. Even when the amount to be removed is controlled according to the expected profile which is to be produced on the web substrate, it is entirely possible that as a result of inevitable non-uniformities in the supply, a new non-uniformity in the laydown profile of the chips occurs before laydown as a web. The delivery elements for the stored supply extend over the entire width of the future profile and cause unavoidable defects in the state of the art.

Also, by way of background, German Preliminary Published Application No. 2 942 163 describes process and apparatus for dividing a forwarded flow characterized in that the forward flow is continuously delivered to a flow divider and constant partial flows are forwarded along the flow divider while others are constantly forwarded through the flow divider. With such a process and apparatus, the amount of chips delivered to this flow divider are exactly divided but the defects present in the spreading material are also forwarded via a distribution chute.

SUMMARY OF THE INVENTION

The present invention is based on the objective of eliminating defects caused by delivery elements in the transverse distribution of a chip web and of conducting an inspection and control of such transverse distribution. By dividing the spreading material taken from the supply over the entire spreading width and by changes in direction of the individual particles, the defects caused by the removal devices are eliminated. A quasi-uniform orientation takes place of the chip particles coming in unevenly in a cascade so that a correct removal from the uniform chip flow can be initiated via a specified web distribution curve when the web is laid down.

With the arrangements of pairs of rakes which do not interfere with each other, an opening of the non-uniform chip flow is obtained since each particle of the chip flow is deflected at least once in its flow direction and, therefore, is guided towards a uniform mixing with the other particles. Such an apparatus, seen over the width, produces a completely uniform chip web on a substrate. It is assumed in this case that for the same bulk height, the bulk density is also constant when uniform material is used. When a specified bulk height which is comparable to a specified bulk density is to be produced, other measures may be taken.

A pickup device may be provided with a forwarding device. According to the invention, it is possible to return the partial amount present in the pickup device or, to distribute it uniformly over the spreading width. With the arrangement of a weir extending over the entire web width it is possible to uniformly deposit a web layer either underneath the web to be formed or on top of the formed web.

If a web obtained in this way is provided, according to the invention, with additional cover layers, at least one spreading roll is additionally provided below the last cascade. As a result, a slight separation of the chips in the transition zone to the cover layers is obtained. Braking the rate of travel and leveling of the chips is enhanced at the same time.

In a further embodiment of the invention, the pickup device has closable openings which are separated from each other by lands and which may be moved with a cooperating rake towards each other and also transversely to the direction of web travel.

In still another embodiment of the invention, the lands of the pickup device may be constructed as rakes.

A particularly advantageous embodiment includes two rakes provided above each other and above the pickup device. The rakes are movable with respect to each other in a direction transverse to the direction of web travel. As a result of this arrangement, the opening width in the pickup device can be most simply regulated which of necessity leads to a control of the picked up amount.

In order to examine the specified web height, a device is used in which a light beam emitted by a light source strikes the chip web over its width transversely to the forwarding direction. A video camera receives this light beam and forwards the information to a computer in which control information for the pickup device is derived. The light lines recorded over a web length corresponding to a board length are stored over the width of the web in the computer, and subsequently, the board surface is shown on a monitor in a color grid associated with the contours. As a refinement of this concept, especially when a change in the web surface is anticipated, not one but several light beams are emitted over the entire width of the web so that web height changes can be recorded by the same stationary video-camera.

BRIEF DESCRIPTION OF THE DRAWING

Novel features and advantages of the present invention in addition to those noted above will become apparent to those of ordinary skill in the art from a reading of the following detailed description in conjunction with the accompanying drawing wherein similar reference characters refer to similar parts and in which.

DETAILED DESCRIPTION OF THE INVENTION

Figure 1:
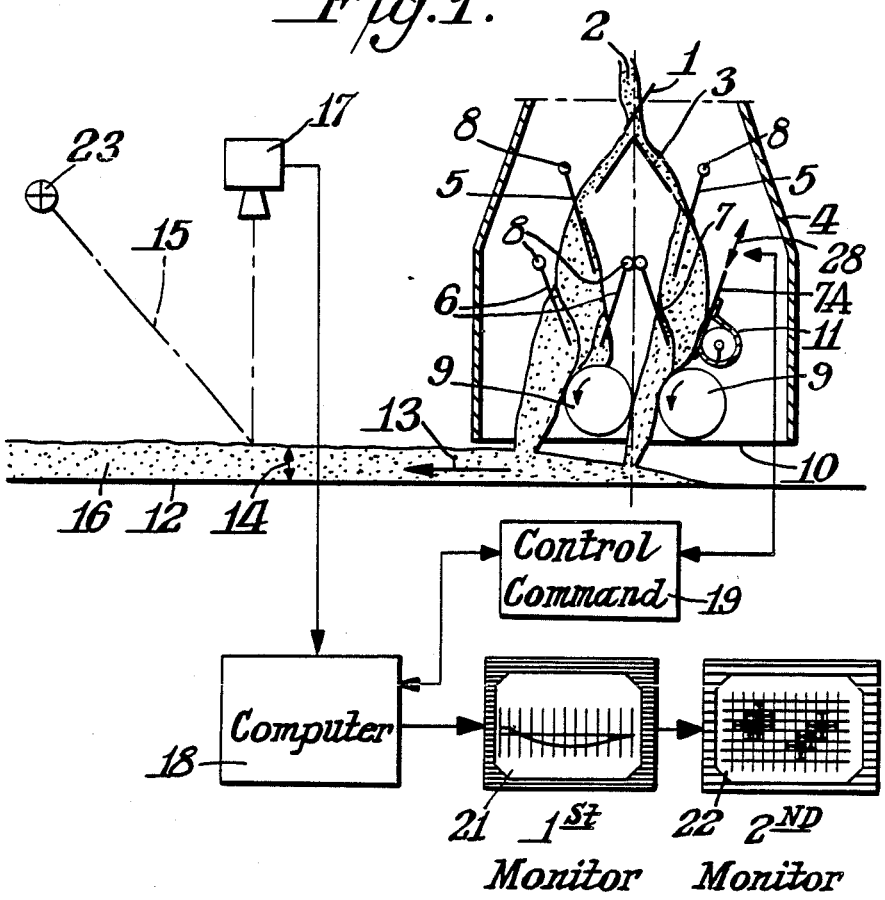
FIG. 1 is side elevational view of apparatus for spreading a chip web according to the present invention, with portions thereof in section to show interior details and certain control mechanisms diagramatically shown.

Referring in more particularlity to the drawing, FIG. 1 shows bulk material 2 being spread in the production of chip boards, waferboard and OSB boards. Bulk material is delivered from a chip supply (not shown) over a rake-like distribution device 1 onto pairs of rakes 5, 6, and 7 located in a housing 4 via distribution chute 3. The pairs of rakes consist of rods each having the same length arranged at a distance from each other and extending over the width of the web of bulk material being dispensed. Preferably, the rods of each rake are fastened at the upper ends thereof to a cross bar 8. The cross bars 8 also extend over the entire width of the housing 4 which is adapted to the width of the web.

The number and the inclination of the rakes shown in FIG. 1 merely represent an exemplified embodiment. Depending on the material to be blended, several cascades one above the other may also be provided. The pair of rakes 5 then forms the first cascade while the pairs of rakes 6 and 7 form the second cascade. According to the invention, the inclination of the pairs of rakes to each other is initiated by rotating the cross bars 8 from outside the housing 4.

In the embodiment of FIG. 1, two spreading rolls 9 are arranged below the last cascade. The function of rolls 9 is to change and brake the uniformly distributed material in its falling direction and/or obtain a slight separation of the chips when a chip board or an OSB board is produced consisting of several layers of chips and the present apparatus is used for the production of the center layer, for example.

In the production of a chip board consisting of several layers, the distribution devices of FIG. 1 may be arranged in series. For example, in the production of three-ply boards, the first and third housings would not include spreading rolls 9 while the second housing would include spreading rolls 9 at its discharge 10.

As shown best in FIG. 1, a pickup device 11 is provided on one rake of the pair of rakes 7 which functions to pick up excess spread material. The function of the pickup device is further explained in connection with FIGS. 2–4. The arrangement of the pickup device of FIG. 1 in front of the rake located the most downstream in the direction of the web forming on a substrate only represents an exemplified embodiment. The pickup device 11 may likewise be located behind the rake which is the most upstream in the direction of web travel, in this case the left rake of the pair of rakes 5.

A web receiving device 12 is shown below the housing 4 extending over the entire spreading width of the bulk material. The web receiving device 12 may be a conveyor belt extending over the width of the chip web or an overlapping flexible or rigid substrate or a combination of such web carriers. The web receiving device 12 moves in the direction of an arrow 13 so that the final web height 14 is obtained at the left end of the housing 4.

A light beam 15 is projected onto the surface of the web over the entire width of the web 16 and produces an image of the web height 14 in a video-camera 17. This image is delivered to a computer 18. When the web height 14 recorded over the width of the web agrees with the specified web height, it is not necessary to forward a control command 19 to an adjusting mechanism 20 (see FIG. 3) in the pickup device 11. A first monitor 21 connected to the computer 18 shows the progression of the web height over the width of a spread web and a second monitor 22 shows the resulting contours in a grid over the length of a finished chip board.

If instead of one light beam 15, according to the invention a number of light beams 15 may be emitted and projected onto the surface of the web by a stationary light source 23. The web surfaces may be recorded with a stationary videocamera 17. The light beams may be substantially different from each other in their height without resulting in diminished spreading accuracy.

Figure 2:
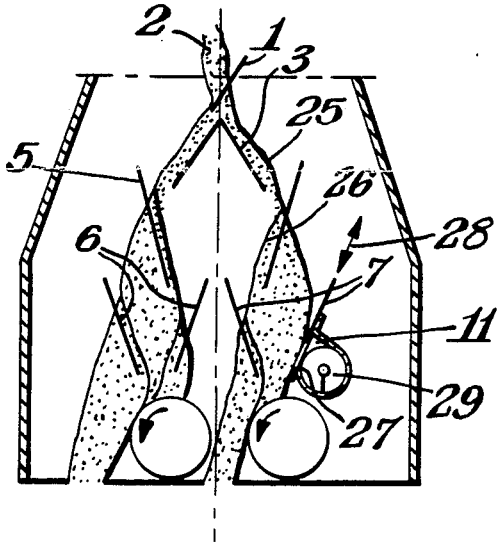
FIG. 2 is an elevational view of a rake distribution device, according to the present invention.

Bulk material 2 entering the housing 4 of FIG. 2 extends over the rake-like distribution device 1 and is distributed via the distribution chute 3. The defects of part of the undeflected bulk material 2 remain until the end of the distribution chute. If one partial flow 25 containing these defects strikes the pair of rakes 5, it is divided by the right hand rake of the pair of rakes 5 into another partial flow 26 and the existing partial flow 25. The other partial flow 26 is subdivided again at the left hand rake of the pair of rakes 7. As a result, possible nonuniformities present at the distribution chute 3 are evened out. The partial flow 25 which might still contain distribution defects from the distribution chute 3 will arrive near the pickup device 11 which also extends over the entire width of the deposited web. Since the pickup device cooperates with the right hand part of the pair of rakes 7, in the exemplified embodiment of FIG. 2, the partial flow 25 is also divided at the pickup device. As a result, distribution defects arriving via the distribution chute 3 have now become so small that these defects can be seen as almost having disappeared. But if a greater accuracy is desired, even more cascade stages may be added as a function of the desired accuracy.

Corresponding to the control commands 19, openings 27 of the pickup device are selectively opened according to a double arrow 28 so that the excess amount of bulk material released from the supply (not shown) can flow into the pickup device 11.

As shown in FIG. 2, the pickup device 11 contains a distribution screw 29 which can carry away the incoming material. Instead of returning the released excess bulk material to the supply, a forwarding device 99 transversely movable back and forth may be employed, as shown in more detail in FIG. 3, in order to even out excess material 30 inside the pickup device. If the pickup device 11 in its lower part has an overflow 31 the excess material will then emerge and, depending on the arrangement of the pickup device, will be laid down downstream or upstream near the last cascade as a web base or a web addition.

Figure 3:
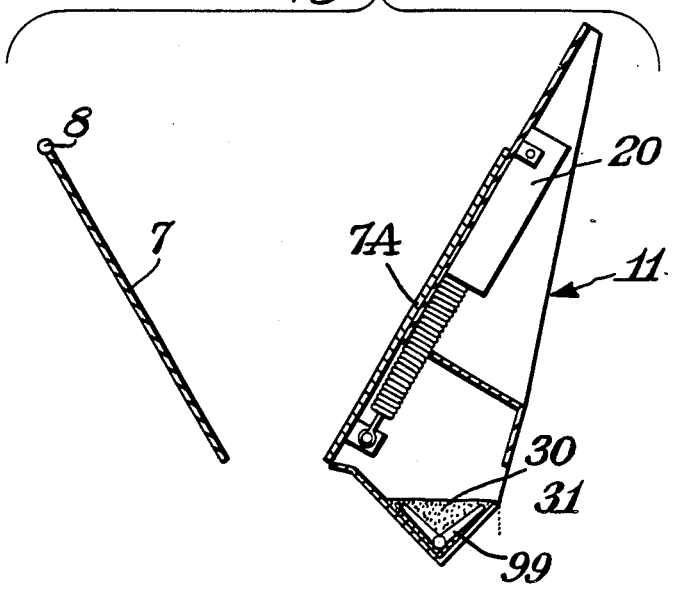
FIG. 3 is a partial side elevational view of the pickup device of FIGS. 1 and 2, according to the present invention.
Figure 4:
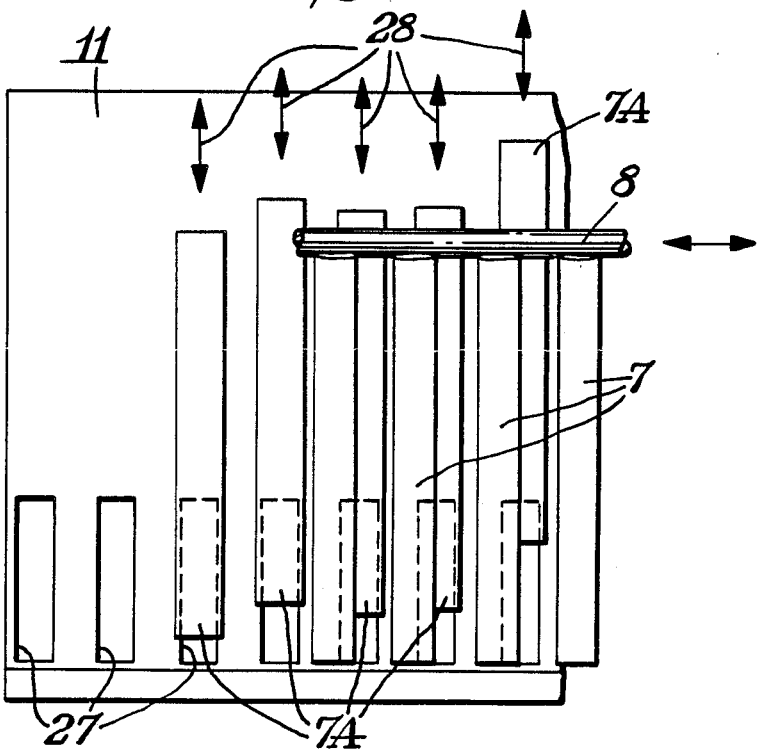
FIG. 4 is a front elevational view of the pickup device shown in FIG. 3.

FIGS. 3 and 4 illustrate the pickup device 11 with the plurality of spaced apart openings 27 and gates 7A that open and close the openings. The operator 20 is responsive to command signals and controls movement 28 of the gate. Lands 40 are formed between the openings 27.

What is claimed is:

1. A process for spreading a chip web flowing in a continuous downward direction from a supply in a width corresponding to a desired web width onto a substrate moving below the supply according to a desired web height distribution across the web transverse to the direction of web travel, the process comprising the steps of flowing a chip mass in a continuous downward direction, dividing the chip mass into partial flows including changing the angular direction of downward flow of at least some of the partial flows, subdividing the partial flows including changing the angular direction of downward flow of at least some of the subdivided flows, directly mixing the subdivided flows in cascades as a result of the angular directional changes of downward flow, and uniformly laying down the chip web of desired width onto the substrate.

2. Apparatus for spreading a chip web flowing from a supply in a width corresponding to a desired web width onto a substrate moving below the supply according to a desired web height distribution across the web transverse to the direction of web travel, the apparatus comprising a rake-like distribution device arranged between the supply and the substrate, a distribution chute next to the distribution device, one pair of spaced apart rakes inclined toward each other and arranged one in front of the other in the direction of substrate movement below the distribution chute with one rake in front of the distribution chute in the direction of substrate movement and the other behind the distribution chute, and at least another pair of spaced apart rakes inclined toward each other and arranged one in front of the other in the direction of substrate movement below the other pair of rakes, each of the rake pairs dividing the chip web from the supply into partial streams.

3. Apparatus for spreading a chip web flowing from a supply in a width corresponding to a desired web width onto a substrate moving below the supply according to a desired web height distribution across the web transverse to the direction of web travel, the apparatus comprising a rake-like distribution device arranged between the supply and the substrate, a distribution chute next to the distribution device, one pair of spaced apart rakes inclined toward each other and arranged below the distribution chute, at least another pair of spaced apart rakes inclined toward each other and arranged below the other pair of rakes, each of the rake pairs dividing the chip web from the supply into partial streams, a chip pickup device located along one of the partial streams of chip flow for selectively collecting chips therefrom, the pickup device including a plurality of closable openings therein extending over the spreading width of the web, and gates over the openings controlling the size of the openings and thereby the amount of chips collected by the pickup device.

4. Apparatus as in claim 3 wherein the pickup device includes a forwarding device for removing and recylcing chips collected by the pickup device.

5. Apparatus as in claim 3 including at least one spreading roll between the partial streams and the moving substrate cascade.

6. Apparatus as in claim 3 wherein the pickup device includes lands between the closable openings, and a rake movable toward and away from the lands and closable openings, and also mounted for movement transverse to the direction of web travel.

7. Apparatus as in claim 6 wherein the lands between the openings in the pickup device are constructed as rakes.

8. Apparatus as in claim 3 wherein the pairs of rakes are mounted for movement transverse to the direction of web travel.

9. Apparatus as in claim 3 including a light source emitting a light beam onto the chip web deposited on the substrate over its width transverse to the direction of web travel, a computer, a videocamera arranged to receive the light beam and forward information on the depth of the web to the computer, and means connecting the computer to the pickup device for controlling the opening and closing of the gates in response to the information about the depth of the web.

* * * * *